United States Patent [19]

Fischer et al.

[11] Patent Number: 4,754,549

[45] Date of Patent: Jul. 5, 1988

[54] MOTOR-DRIVEN CHAIN SAW HAVING AN ANTI-KICKBACK SPROCKET

[75] Inventors: Manfred Fischer, Asperg; Wilfried Linke, Winnenden; Werner Hartmann, Ostfildern, all of Fed. Rep. of Germany

[73] Assignee: Andreas Stihl, Waiblingen, Fed. Rep. of Germany

[21] Appl. No.: 115,265

[22] Filed: Oct. 29, 1987

[30] Foreign Application Priority Data

Nov. 29, 1986 [DE] Fed. Rep. of Germany ..... 3640857

[51] Int. Cl.[4] ..... B27B 17/04

[52] U.S. Cl. ..... 30/384; 83/830

[58] Field of Search ..... 30/383–385; 83/820, 830–834

[56] References Cited

U.S. PATENT DOCUMENTS 4,387,615 6/1983 Lemery ..... 83/833 X 4,593,591 6/1986 Beerens ..... 83/834

FOREIGN PATENT DOCUMENTS 259180 1/1949 Switzerland ..... 30/384

*Primary Examiner*—Douglas D. Watts

*Attorney, Agent, or Firm*—Walter Ottesen

[57] ABSTRACT

With motor-driven chain saws, there is the danger that the chain saw will be thrown upwardly and rearwardly when it is applied to wood by the user with a forward thrust. Serious injuries can then occur. The invention is directed to a motor-driven chain saw which is so configured that the cutting forces are automatically reduced in response to the occurrence of excessive reaction forces so that the reaction force is immediately reduced to a tolerable amount thereby eliminating the kickback effect. The drive links engaging the nose sprocket of the guide bar are so dimensioned that they can further pivot in the tooth gaps of the nose sprocket out of their normal position and, in this way, take the cutting links with them in such a manner that the free angle of the cutting teeth is reduced. The drive links are latched in the pivoted-in position on the nose sprocket in order to assure that the cutting links will retain the position with the reduced free angle over the entire turnaround region of the guide bar. For this purpose, latches are provided on the drive links and/or on the nose sprocket.

15 Claims, 11 Drawing Sheets

17
26,1
30
29
17
13,1
26A
Sr1
25
28A
27A
32
Kv
33
27,1
26B
28,1
β1
15,1
15,1
28B
27B
11,1
16,1
Sr2
β2
γ
U pr
29
30
17
13,1
17
33
32
28,1
26,1
16,1
11,1
U 17
26,2
29
30
17
13,2
25
32,2
Kv
26,2A
44
44
46
46
43
33,2
ß1
15,2
15,2
26,2B
27,2
28,2
16,2
11,2
45
45
ß2
γ
u pr
33,2
26,2B
13,2
25
26,2A
Kv
46
43
32,2
11,2
27,2
28,2
u
16,2

MOTOR-DRIVEN CHAIN SAW HAVING AN ANTI-KICKBACK SPROCKET

FIELD OF THE INVENTION

The invention relates to a motor-driven chain saw and to a guide bar and saw chain assembly therefor. The saw chain includes cutting links as well as connecting links and drive links interconnected to form an endless chain.

BACKGROUND OF THE INVENTION

Motor-driven chain saws of the kind referred to above, have a motor housing and a guide bar directed forwardly thereof for accommodating the endless saw chain. The guide bar includes a nose sprocket which is rotatably journalled at the forward end thereof. The nose sprocket engages the saw chain with its teeth such that the drive links lie in the tooth gaps with their foot portions. The saw chain has depth limiters which are formed on the cutting links and limit the depth of cut into the wood. Reaction forces can develop when cutting into soft wood and/or when the operator of the chain saw applies a large forward thrust thereto. These reaction forces can lead to the chain saw being thrown back at the operator, that is, to the so-called kickback. The chain saw which is thrown backwardly and upwardly can cause serious accidents. Accordingly, various ways have been sought to prevent this accident danger.

SUMMARY OF THE INVENTION

It is an object of the invention to provide a motor-driven chain saw of the kind described above wherein the kickback effect is substantially eliminated when an excessive reaction force is directed against the saw chain.

The configuration and support of the drive links pursuant to the invention makes possible a pivoting-in of these links in the tooth gaps with the cutting link being pivoted in such a manner that the free angle of the cutting-tooth roof is reduced. This cutting link follows the pivoting-in drive link and the free angle can become zero or negative. In this way, the cutting forces and therefore also the reaction forces are reduced which can cause a kickback of the chain saw. The drive links of the saw chain of the invention are adapted to the tooth flanks of the nose sprocket in such a way that after the drive links have pivoted in, a detent or latching results which acts against a return pivoting to the starting position and so holds the drive links in their position until leaving the nose sprocket.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
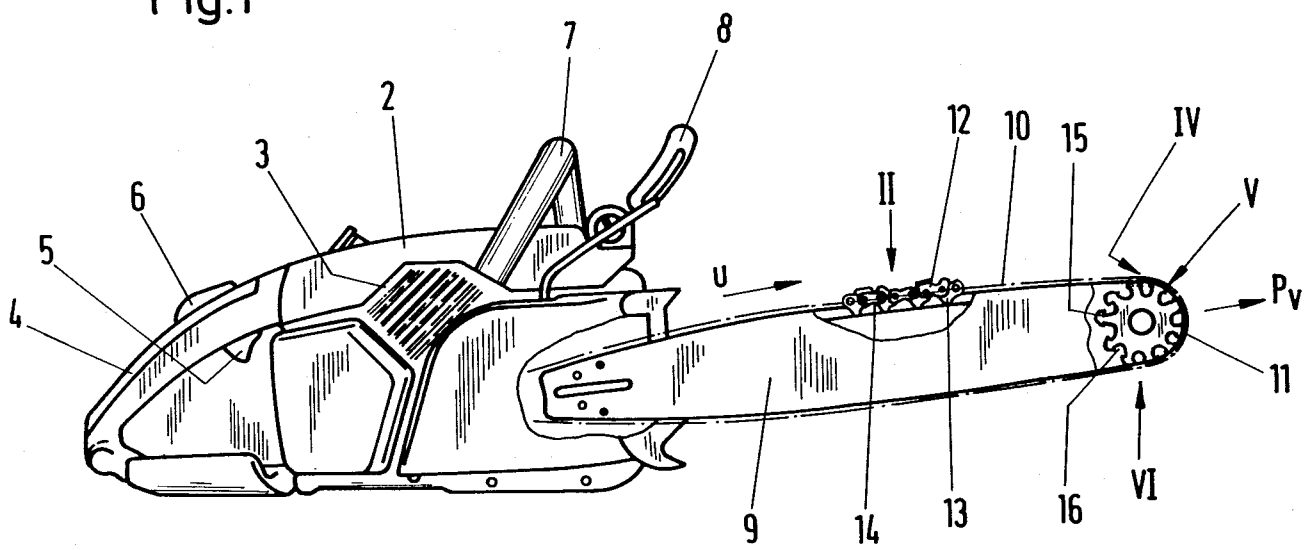
FIG. 1 is a schematic side elevation view of a portable motor-driven chain saw having a guide bar.

The motor-driven chain saw 1 shown schematically in FIG. 1 includes a housing 2 which encloses a drive motor 3 which in this embodiment is an internal combustion engine. The rear handle 4 is attached to the housing 2. A gas lever 5 and a gas lever latch 6 are mounted on the handle 4. In addition, a forward bail handle 7 is provided in front of which a hand guard 8 is mounted. A guide bar 9 extends forwardly from the housing 2 on which a continuous saw chain 10 is guided and driven by the drive motor 3 in the direction of arrow U around the guide bar.

A nose sprocket 11 for the saw chain 10 is rotatably journalled on the forward end of the guide bar 9. As can be especially seen in FIGS. 2 and 3, the saw chain includes cutting links 12, drive links 13 and connecting links 14 which are pivotally interconnected. The drive link 13 engages in the tooth gaps 16 (FIGS. 4 and 5) between the teeth 15 of the nose sprocket 11.

Figure 2:
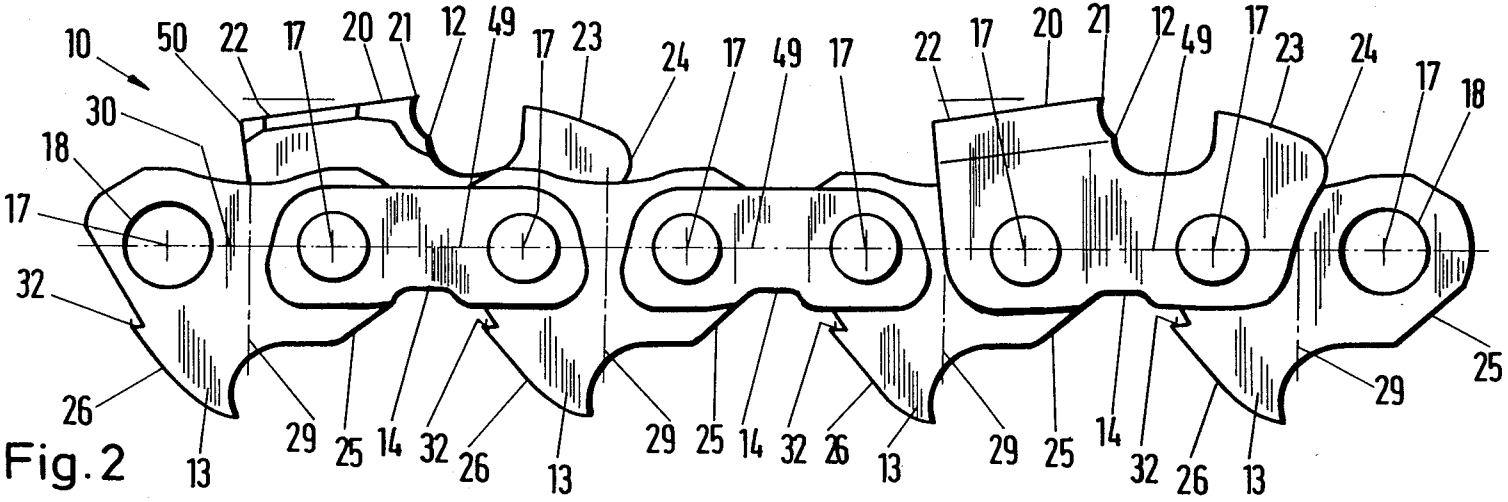
FIG. 2 is an enlarged side elevation view of a portion of the saw chain of the chain saw in the region II of FIG. 1.
Figure 3:
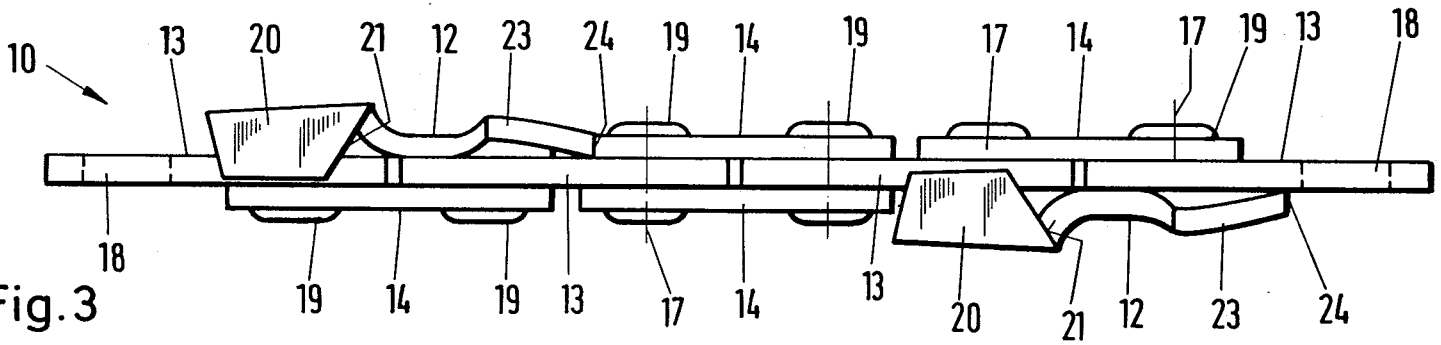
FIG. 3 is a plan view of the portion of the saw chain shown in FIG. 2.

All chain links 12, 13 and 14 each have two pivot axes 17 which are defined by rivet pins 19. The pivot axes 17 lie one behind the other when viewed in the direction of movement of the chain and are spaced from each other. The rivet pins 19 extend through corresponding bores 18 of the chain links and pivotally connect the chain links which are arranged one behind the other. As shown in FIGS. 2 and 3, the spacing between the pivot axis 17 on the drive links 13 is smaller than on the cutting links 12 and on the connecting links 14. The cutting links 12 and the connecting links 14 are configured as side links in the embodiment shown; whereas, the drive links 13 are center links which are disposed between two connecting links or between a cutting link 12 and a connecting link 14.

In its rearward region, the cutting link 12 extends upwardly to a cutting tooth 20 which is bent over transversely to the plate-like body of the cutting link and which has a cutting edge 21 at its forward end viewed in the direction of movement U. The saw tooth 20 is inclined toward the rear starting from the cutting edge 21 so that a free angle $\alpha$ is formed. The magnitude of the free angle is approximately 5° to 10° and is preferably approximately 7°. This magnitude enables a high cutting capacity to be achieved and nonetheless substantially eliminates the kickback effect in combination with the arrangement according to the invention.

An upwardly projecting depth limiter 23 is formed on the forward portion of the cutting link 12 and is inclined somewhat with respect to the plate-like body of the cutting link as shown in FIG. 3. The depth limiter 23 is arranged ahead of the saw tooth 20 and is spaced therefrom. The depth limiter 23 is so configured that its rounded forward edge 24 extends over the center region of the drive link 13 in the direction toward the latter's forward pivot axis 17.

The saw chain 10 can be configured as a low-profile chain. In such a chain, the distance between the pivot axes 17 of the cutting link 12 along the connecting line 49 is greater than the height of the tooth which is defined by the largest spacing of the cutting edge 21 to the connecting line 49. The cutting edge 21 is the point of force engagement for the cutting and reaction forces. The tooth roof 22 with the cutting edge 21 is sloped transversely to the direction of movement and therefore likewise has a free angle in this direction so that the spacing of the cutting edge 21 to the plane containing the connecting line 49 is not constant along the cutting width. The cutting tooth can also be configured differently and, for example, can have a rearward increase in elevation (when viewed in the direction of movement) as well as other projections, recesses, sloped portions and the like. The saw chain 10 is characterized as a low-profile chain if the proportion of the above-mentioned spacings is the same or greater than 1.1, that is, the spacing between the pivot axes 17 is at least one tenth greater than the largest elevation of the saw tooth 20 measured between the plane containing the connecting line 49 and the cutting edge 21.

Figure 4:
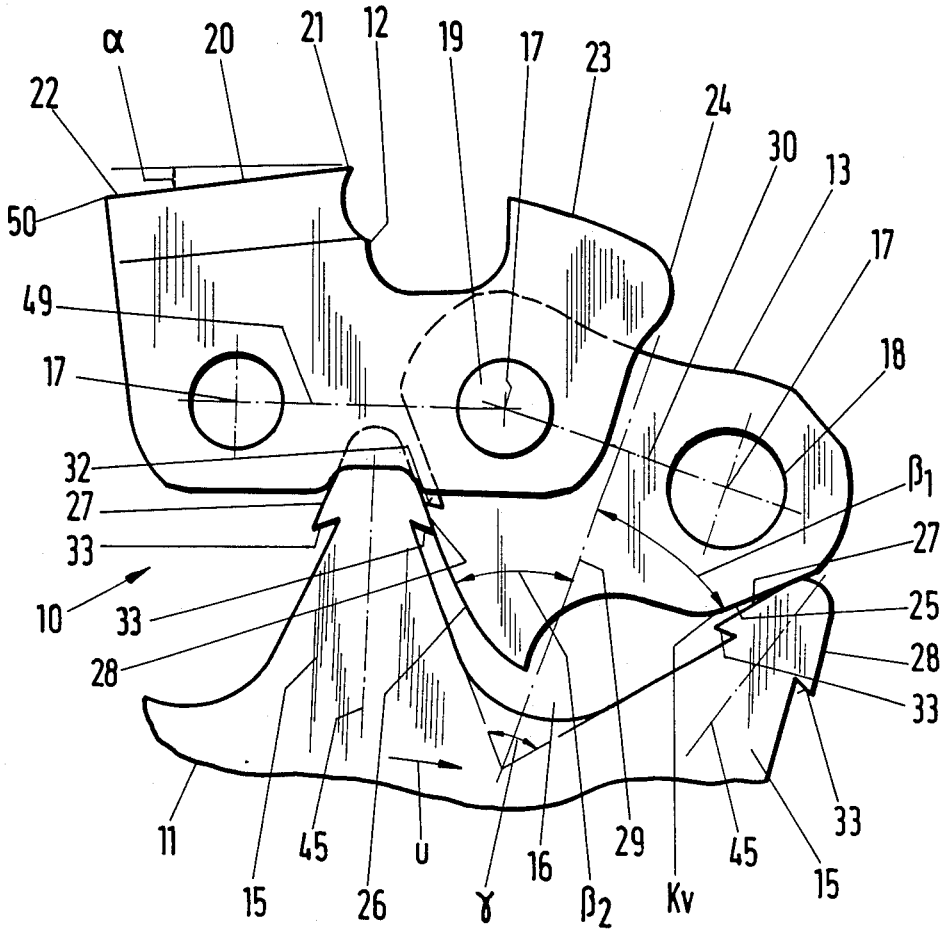
FIG. 4 is an enlarged side elevation view of a portion of the saw chain of region IV of FIG. 1 as it enters onto the nose sprocket.

As shown especially in FIG. 4, the drive link 13 engaging the tooth gap 16 of the nose sprocket 11 has two flanks 25 and 26. The forward flank 25 in chain direction lies approximately in point contact (referred to the revolving direction U of the saw chain) on the rearward tooth flank 27 of the forward tooth 15, while the rearward stepped flank 26 of the drive link 13 lies with a portion of its inner section in surface contact engagement with the forward tooth flank 28 of rearward tooth 15 referred to the direction U. The opening angle of the tooth gap 16 is bounded by the tooth flanks 27 and 28. This opening angle is approximately 80° in the illustrated embodiment; however, it can be smaller or larger. A latch stop 32 is formed by the step of the rearward drive link flank 26 for which an abutment 33 is provided on the tooth 15. This latch is ineffective in the normal engagement position of the drive link as shown in FIG. 4.

The straight line 29 running centrally between the two pivot axes 17 perpendicularly intersects the connecting line 30 of both axes 17 and therefore defines the central perpendicular. The drive link 13 is configured to be unsymmetrical with reference to line 29 such that the forward flank angle $\beta 1$ formed between the partition line 29 and the forward flank 25 is greater than the rearward flank angle $\beta 2$ which encloses the inner flank section of flank 26 with the partition line 29. In this way, a wedge gap Kv is provided between the forward flank 25 of the drive link 13 and the rearward flank 27 of the leading tooth 15. In the position shown in FIG. 4, the cutting link 12 lies at right angles to the symmetry plane 45 with the connecting line 49 of its pivot axes 17, the symmetry plane 45 being that of the tooth 15 disposed behind the drive link 13.

The cutting links have this position on the nose sprocket when the saw chain 10 is loaded only by the pulling forces caused by the drive, that is, when the saw chain runs at idle. With this condition, the roof 22 of the saw tooth 20 is inclined with respect to the cutting edge 21 so that the normal free angle $\alpha$ is provided.

Figure 5:
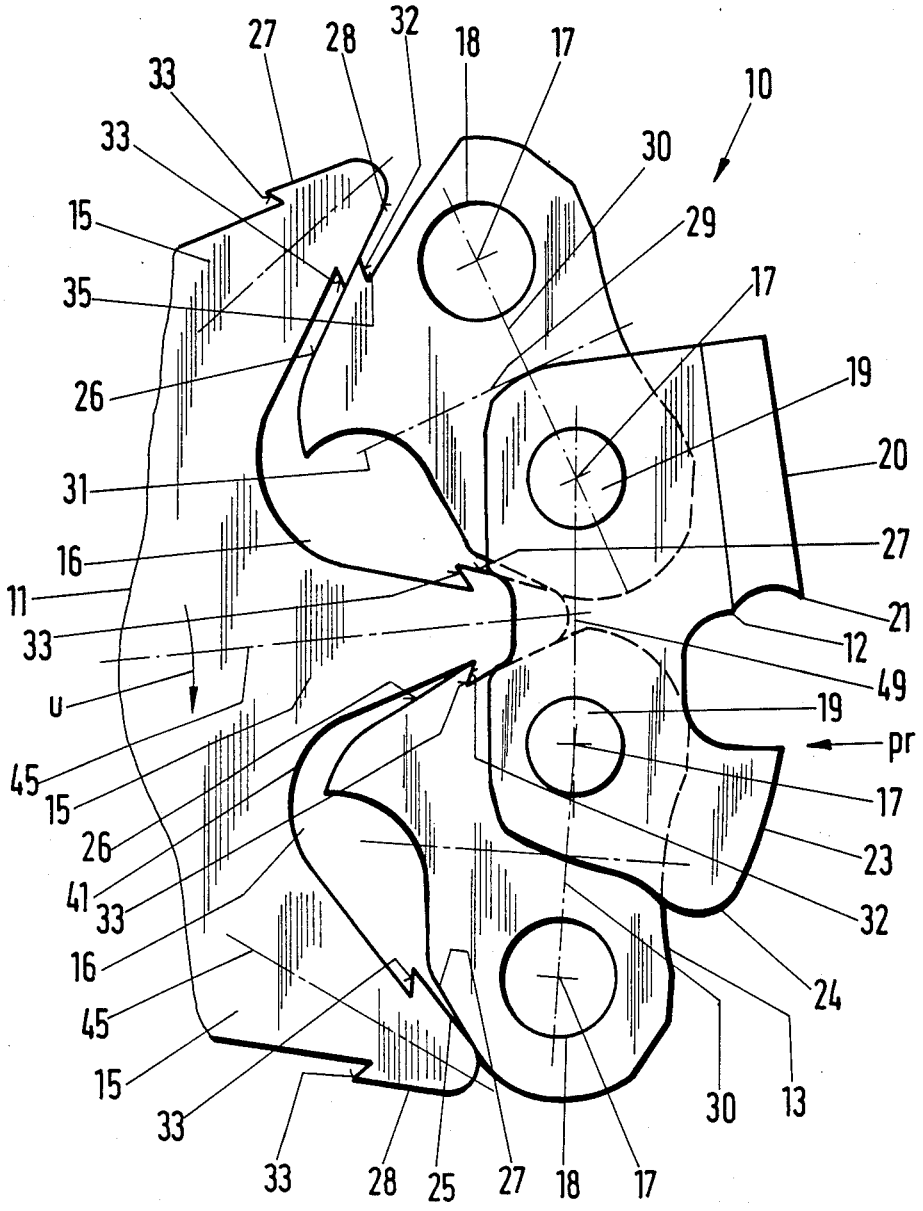
FIG. 5 is an enlarged side elevation view of a portion of the saw chain in region V of FIG. 1 wherein the saw tooth is pivoted as a consequence of a reaction force from the forward thrust acting against the chain.

If the guide bar 9 with the revolving saw chain 10 is guided into the wood to be cut, a reaction force Pr results from the required forward thrust Pv (FIG. 1) which is needed for this purpose. The reaction force Pr also is dependent upon the cutting force and operates with a component pr on the depth limiter in the direction shown in FIG. 5 by the arrow whereby the leading drive link 13 is pivoted into the tooth gap 16; this pivoted-in position of the drive link is shown in FIG. 5 for the leading drive link 13. The diving-in of the drive link in the tooth gap 16 is facilitated by the wedge gap Kv having a wedge angle which thereby becomes smaller, while the rearward drive-link flank 26 at first glides inwardly at the outer section of the stepped tooth flank 28 and then engages with its latch stop 32 underneath the abutment 33. As shown in FIG. 5, the connecting pivot axis 17 of the drive link 13 is displaced with the cutting link 12 inwardly in the direction of the tooth gap 16 when the drive link 13 is pivoted in. In this way, the cutting link 12 also pivots so that the saw tooth 20 with its roof 22 is positioned less steeply to the path traced by the cutting edge 21; thus, the free angle $\alpha$ is reduced and can become zero or even negative. In this way, the cutting force becomes less so that the reaction force Pr is also reduced which causes the throwback (kickback). Therefore, the reduction of the free angle $\alpha$ eliminates or reduces the kickback danger.

Figure 6:
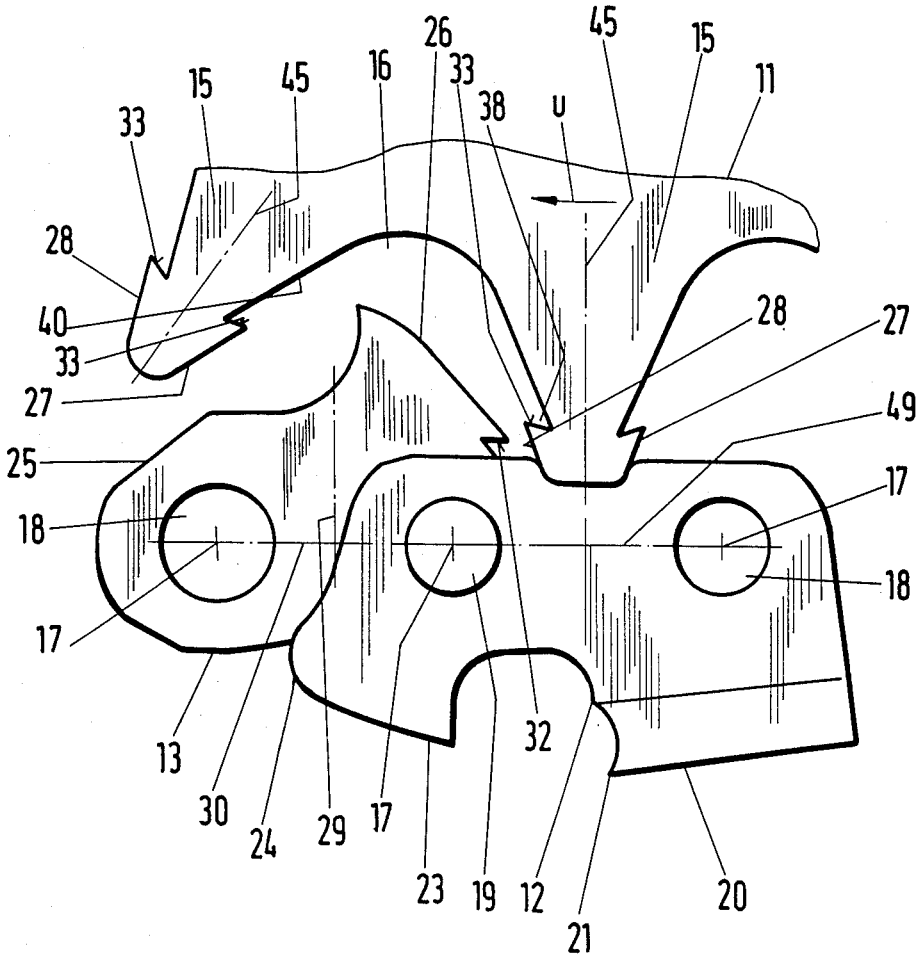
FIG. 6 is an enlarged side elevation view of a portion of the saw chain in region VI of FIG. 1.

In the pivoted-in position of the drive link, the connecting line 49 of the cutting link 12 lies inclined to the radial of the nose sprocket 11. The radial lies in the symmetry plane 45 of the tooth 15. The cutting link 12 has the tendency to pivot back into its starting position (FIG. 4) as a consequence of the force acting on the cutting edge 21. However, a return pivoting in the turnaround region of the guide bar 9 would make the intended assurance against kickback ineffective. The drive links 13 are therefore so configured that they have a self-holding function in their pivoted-in position until leaving the nose sprocket 11. In the embodiment described, this is obtained by means of the latch stop 32 in combination with the abutment 33 provided on the tooth 15, since this latching defines a stop against the return pivoting of the drive link. The stop is first released when the drive link leaves the nose sprocket since then both drive-link flanks lift away from the tooth flanks of the nose sprocket (FIG. 6).

Figure 7:
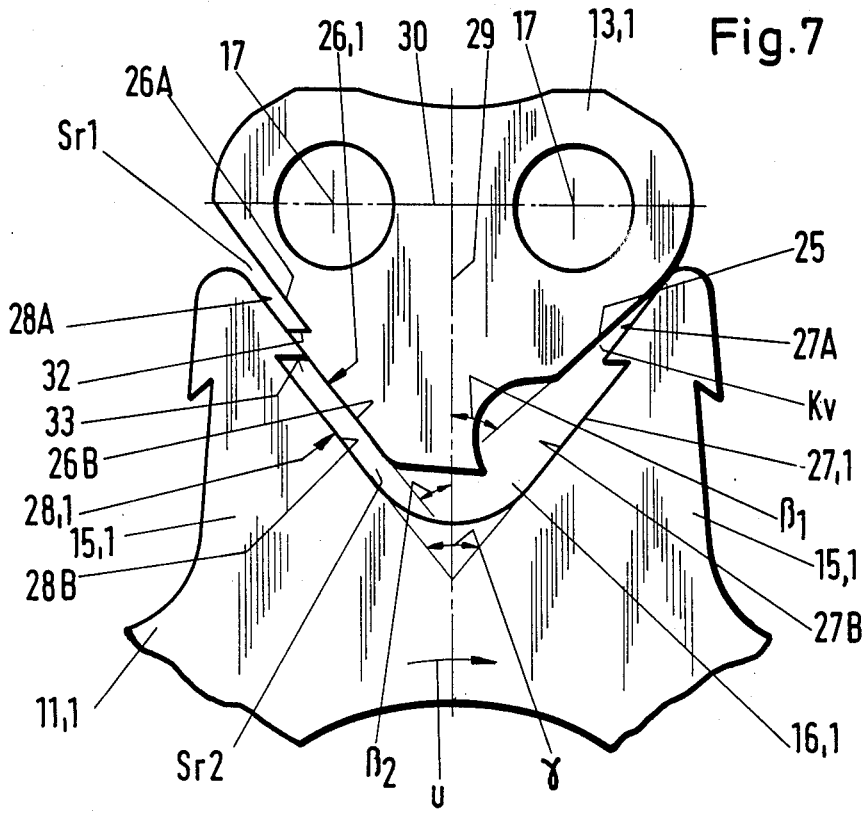
FIG. 7 is a drive link of the saw chain of another embodiment in the engaging position on the nose sprocket for the normal load condition.
Figure 8:
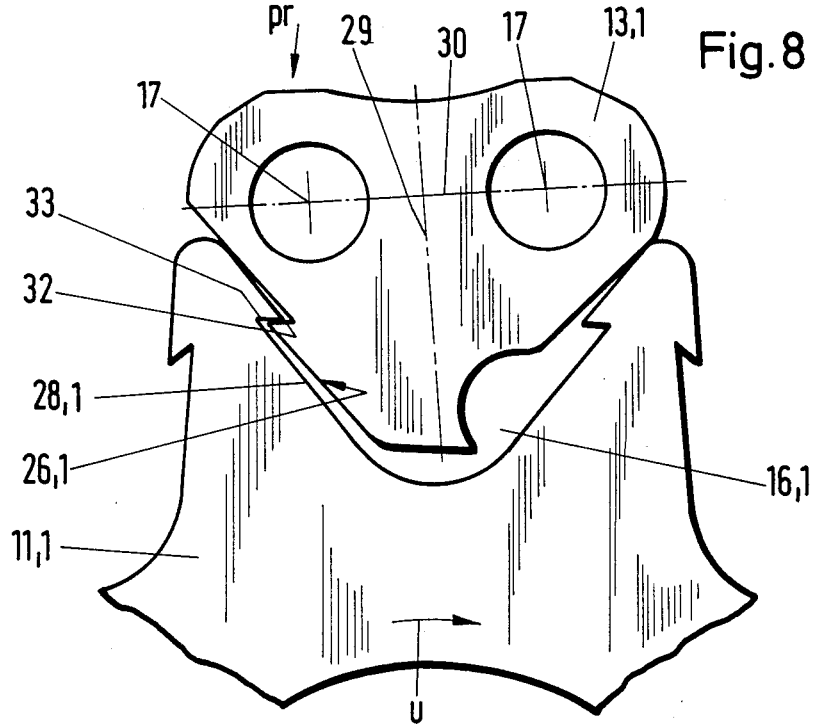
FIG. 8 shows the drive link of FIG. 7 in the position into which it has been pivoted by the additional load during a forward thrust.

FIGS. 7 and 8 show a drive link 13.1 which is similar to the drive link 13 and is likewise configured to be asymmetrical with the forward flank angle $\beta 1$ being greater than the rearward flank angle $\beta 2$ and the sum of these angles is greater than the opening angle $\gamma$ of the tooth gap 16. In order to block the drive link 13.1 in the pivoted-in position (FIG. 8) against a return pivoting, the rearward drive-link flank 26.1 has a stepped configuration also in this embodiment so that two straight-line sections 26A and 26B are provided and lie in parallel planes. In this way, the latch stop 32 is formed.

The nose sprocket 11.1 has teeth 15.1 whose flanks 27.1 and 28.1 are subdivided into respective step-shaped set-off sections (27A, 27B) and (28A, 28B). In this way, an abutment 33 is formed on the flank 28.1 which overlaps the latch stop 32 in a form-tight manner when the drive link 13.1 is pivoted in the tooth gap 16 (FIG. 8). The teeth 15.1 of the nose sprocket are symmetrically configured so that an abutment is provided also on the flank 27.1 for the situation that the saw chain revolves in the reverse direction or if the guide bar is turned over. The latch stop 32 is configured as a transverse surface because of the step in the drive-link flank 26.1 which engages under the abutment 33 in the latched position in such a manner that a surface contact engagement is provided. The transverse surface forming the latch stop lies in an acute angle to the flank sections 26A and 26B.

The abutment 33 likewise lies in the acute angle to the sections 28A and 28B of the tooth flank 28.1, the transverse surface defining the abutment. The flank 26.1 of the drive-link 13.1 and the tooth flanks of the teeth 15.1 of the nose sprocket 11.1 are therefore stepped in a dove-tail manner.

Under normal load of the saw chain, the drive-link 13.1 is in the position illustrated in FIG. 7 with the wedge gap Kv being between the forward flank 25 of the drive-link 13.1 and the outer section 27A of the tooth flank 27.1; whereas, two mutually displaced gap openings Sr1 and Sr2 of constant width are formed on the rear drive-link flank 26.1 since the flank section 26B lies in surface contact engagement with its outer end region against the flank section 28A of the tooth 15.1. After the drive link 13.1 dives into the tooth gap 16 under the component pr of the reaction force Pr, the gaps are substantially closed (FIG. 8) and the drive-link is latched against a return pivoting by means of the latching on abutment 33 until it leaves the nose sprocket.

Figure 9:
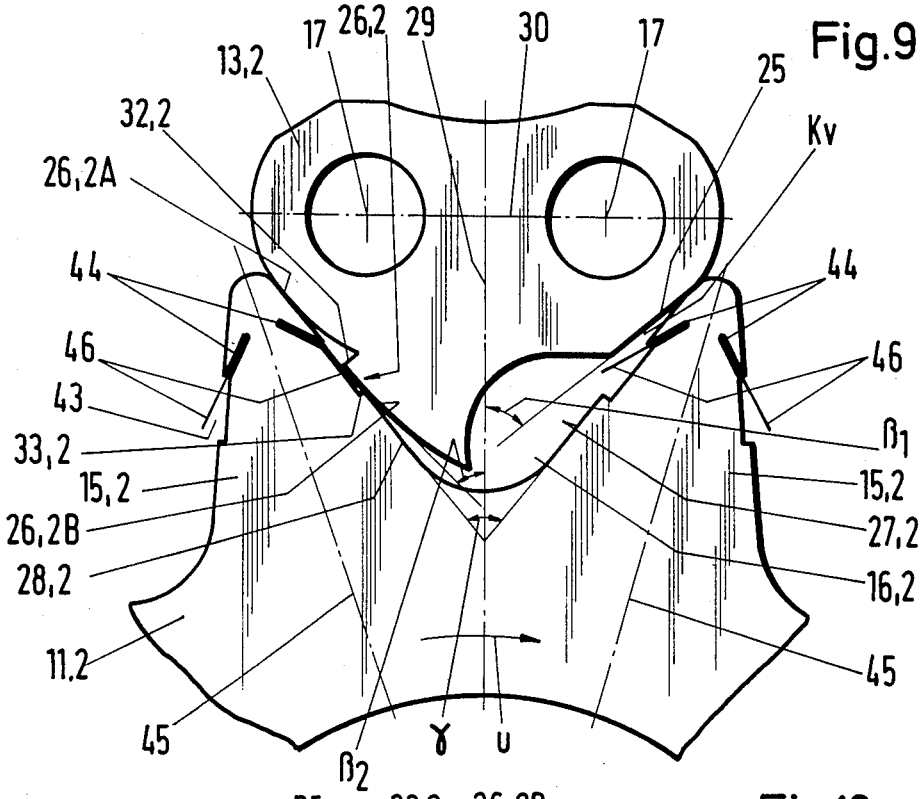
FIG. 9 is a drive link according to another embodiment with associated nose sprocket in an illustration corresponding to that of FIG. 7.
Figure 10:
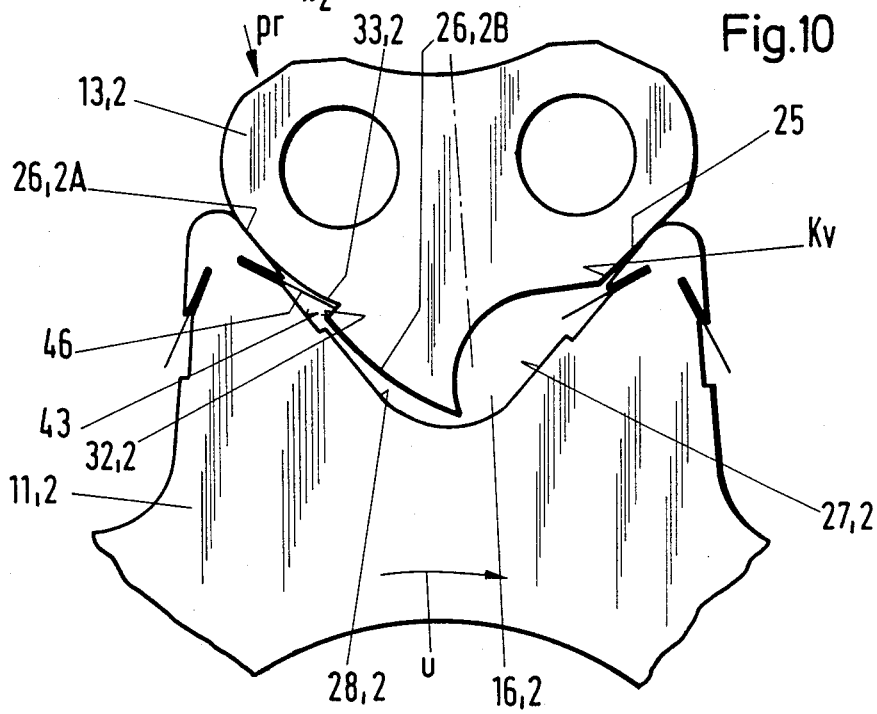
FIG. 10 shows the drive link of FIG. 9 in the pivoted-in position corresponding to that shown in FIG. 8.

The drive link 13.2 shown in FIGS. 9 and 10 has a rearward flank 26.2 which is subdivided by means of a step into sections 26.2A and 26.2B with the outer section 26.2A being convex. The inner section 26.2B is likewise convex in the foot region of the drive-link. This drive-link is likewise configured to be unsymmetrical to the partition line 29. The forward flank angle $\beta 1$ is greater than the rearward flank angle $\beta 2$ which the partition line 29 forms with the tangent which lies on the outer straight-lined end of the inner flank section 26.2B (FIG. 9). The sum of angles 81 and $\beta 2$ is greater than the opening angle $\gamma$ of the tooth gap 16.2 so that in the position of the drive link 13.2 (FIG. 9) corresponding to the normal load condition, the wedge gap Kv is provided between the forward drive-link flank 25 and the tooth flank 27.2 of the leading tooth 15.2 of the nose sprocket 11.2.

The rearward flank 26.2 lies with its sections 26.2A and 26.2B in surface contact engagement with the tooth flank 28.2 of the trailing tooth 15.2. A latch stop 32.2 is provided by means of the stepped configuration of the rearward drive-link flank 26.2 with a transverse surface which is substantially at right angles to the outer end of the inner flank section 26.2B. A leaf spring 46 forms the abutment 33.2 for the latch stop. Such a leaf spring 46 is inserted in respective ones of the flanks 27.2 and 28.2 of the teeth 15.2 of the nose sprocket 11.2. For this purpose, a slit 44 is provided in the corresponding tooth flank and is aligned so as to be inclined to the symmetry plane 45 of the tooth 15.2. A recess 43 borders on the slit 44 so that the leaf spring 46 lies recessed in the tooth flank when the drive-link 13.2 lies with its flank section 26.2B on the tooth flank (FIG. 9).

When the drive-link pivots under the action of the force component pr, the flank 25 of the drive-link glides outwardly while the wedge gap Kv becomes smaller and the flank section 26.2B lifts away from the tooth flank 28.2 (FIG. 10). At the same time, this flank section displaces itself inwardly so that the leaf spring 46 pivots out and latches in the recess of the drive-link flank with the latch stop 32.2 adjoining this recess resting against the end of the leaf spring 46 forming the abutment 33.2. The rearward flank of the drive-link is then only supported with its upper section 26.2A on the tooth flank 28.2. However, the drive-link is held in the pivoted-in position by means of the latch until it leaves the nose sprocket 11.2.

The symmetrical arrangement of the leaf springs 46 on both tooth flanks 27.2 and 28.2 permits the saw chain to revolve in a direction opposite to the direction U, that is, this arrangement permits the guide bar 9 to be used in a turned-over position while retaining the blocking action for the drive links.

Figure 11:
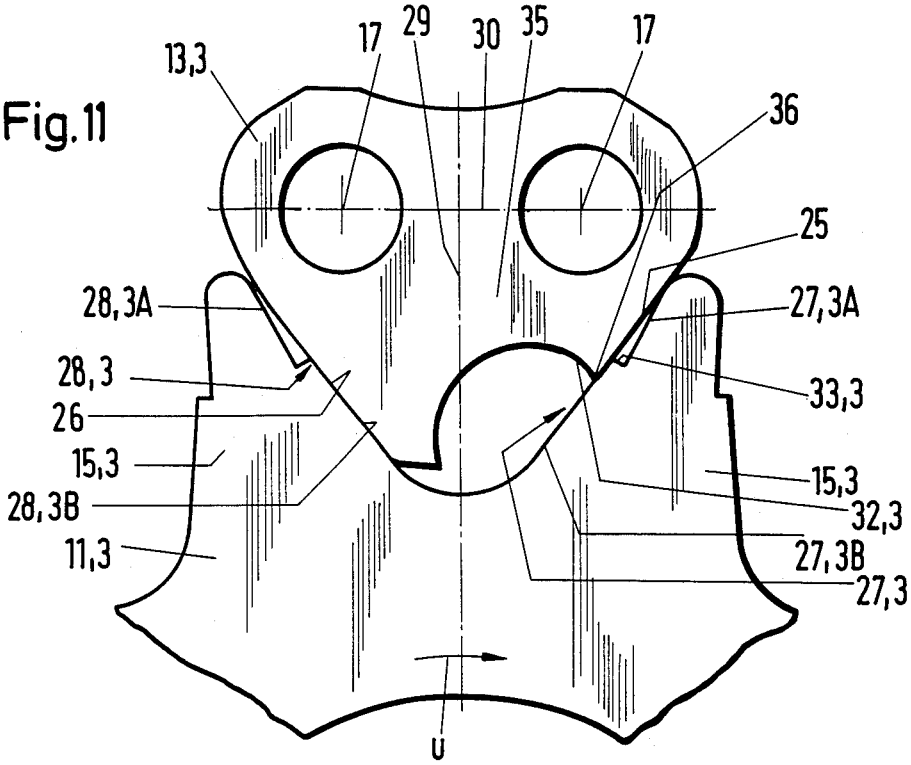
FIG. 11 is a drive link according to another embodiment with the associated nose sprocket in an illustration corresponding to that of FIG. 7.
Figure 12:
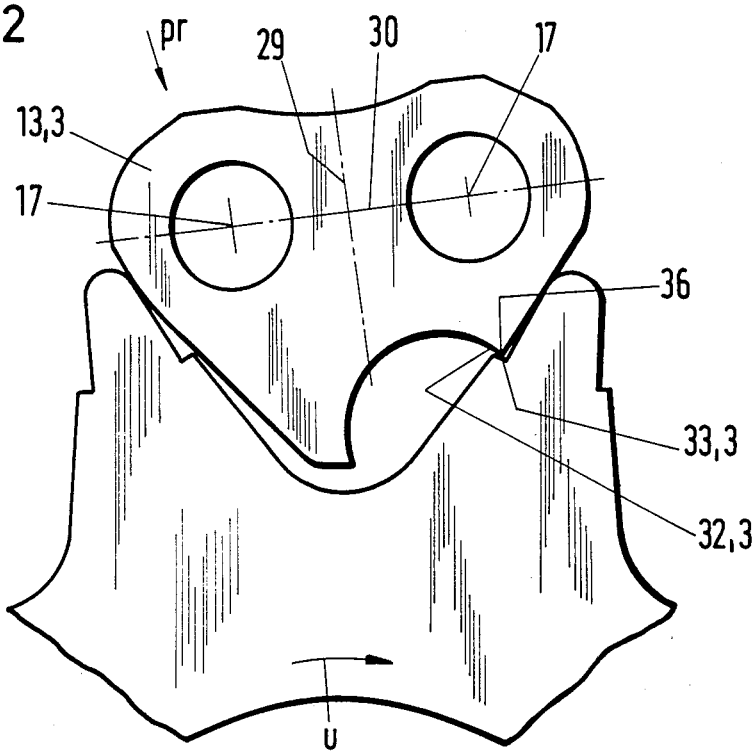
FIG. 12 is a drive link according FIG. 11 in the pivoted-in position corresponding to that shown in FIG. 8.

In the embodiment of FIGS. 11 and 12, the drive link 13.3 is configured so as to be symmetrical to the partition line 29 with reference to its flank angles with the sum of both flank angles being equal to the opening angle of the tooth gap 16.3 of the nose sprocket 11.3. The flanks 27.3 and 28.3 of the teeth 15.3 of the nose sprocket are stepped so that an abutment 33.3 is formed. Under normal load, the drive link 13.3 lies with its rearward flank 26 against the stepped forward tooth flank 28.3 of the rearward tooth 15.3 referred to the direction U with an approximately point contact engagement provided at the outer section 28.3A of the tooth flank and with a surface contact engagement at the inner section 28.3B (FIG. 11).

The forward flank 25.3 of the drive link 13.3 lies in the same manner in part approximately in point contact engagement on the outer section 27.3A and in part in surface contact engagement with the inner section 27.3B of the other tooth flank 27.3. The surface which borders on the forward corner 36 of the foot part 35 of the drive link serves as a latching stop 32.3. The configuration of the corner 36 by means of a circularly-shaped recess in the foot part 35 of the drive link is usual with these chain links.

The drive link 13.3 pivots under the force component pr of the reaction force Pr in response to the thrust force Pv (FIG. 1) in such a manner that its rearward flank 26 lifts away from the section 28.3B of the tooth flank 28.3 and the forward flank 25 slides outwardly on the section 27.3B of the tooth flank 27.3 until the corner 36 of the foot 35 latches into the recess (FIG. 12) defined by the abutment 33.3. In this way, the drive link 13.3 is latched in this position during the movement through the turnaround path of the guide bar 9 (FIG. 1).

Figure 13:
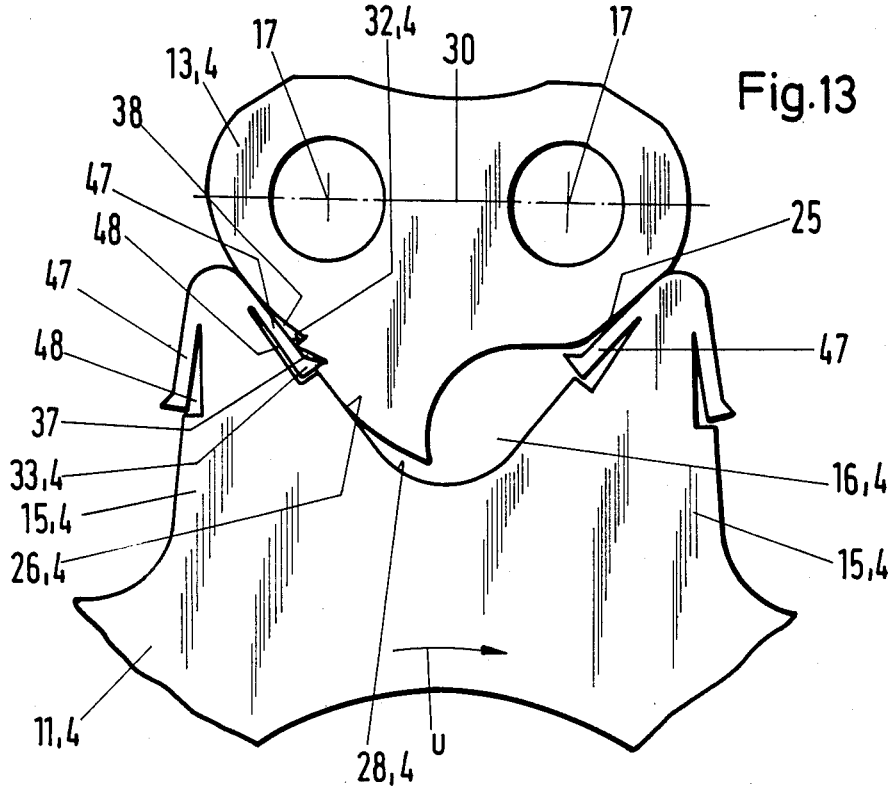
FIG. 13 is a drive link of another embodiment with the associated nose sprocket in an illustration corresponding to that of FIG. 7.
Figure 14:
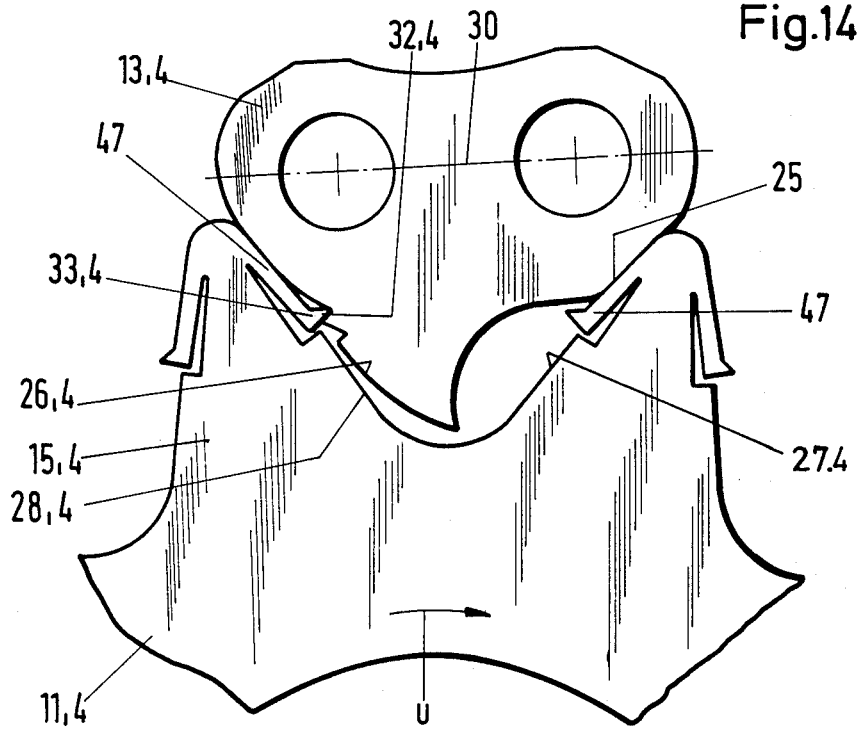
FIG. 14 shows the drive link of FIG. 13 in the pivoted-in position corresponding to the illustration of FIG. 8.

The embodiment of FIGS. 13 and 14 corresponds to the drive link 13.2 of FIGS. 9 and 10 with respect to the unsymmetrical assembly and the spring latching. A spring is likewise provided as an abutment 33.4 which is here configured as a resilient arm 47 of the tooth 15.4. Every tooth 15.4 of the nose sprocket has for reasons of symmetry such a resilient arm 47 on both of its flanks 27.4 and 28.4 which is bent outwardly from a slit 48 into the tooth gap 16.4 and pivots into this slit 48 under load from the drive link 13.4. For this purpose, a saw tooth-like recess 37 is provided on the rearward flank 26.4 of the drive link 13.4 in which the abutment 33.4 latches when the drive link is in its position corresponding to the normal load (FIG. 13).

A second recess 38 is provided next to the recess 37 and likewise has a sawtooth shape and is bounded by the transverse surface forming the latch stop 32.4. This transverse surface is engaged from below by the abutment 33.4 in the pivoted-in position of the drive link 13.4 (FIG. 14). In this position, the arm 47 is swung into the gap 16.4 with the flank 26.4 of the drive link being lifted away from the tooth flank 28.4. In the unpivoted starting position of the drive link 13.4, a wedge gap Kv exists between the outpivoted arm 47 of the leading tooth 15.4 and the forward flank 25 of the drive link. The wedge gap Kv is closed in the pivoted-in position of the drive link.

Figure 15:
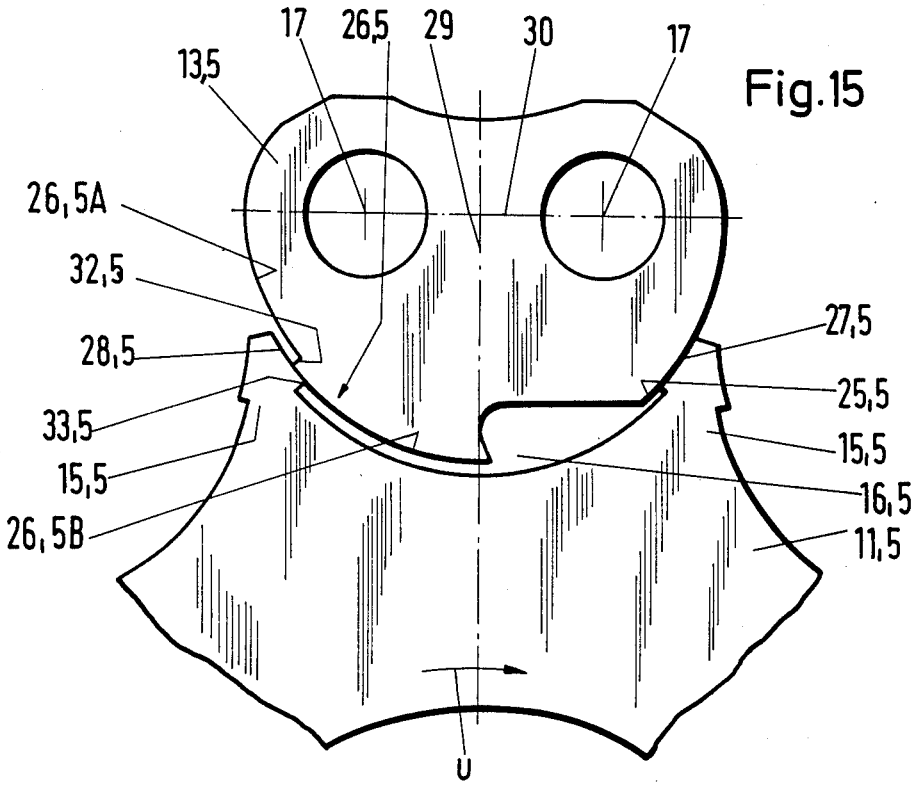
FIG. 15 is a drive link of another embodiment with the associated nose sprocket in an illustration corresponding to FIG. 7.
Figure 16:
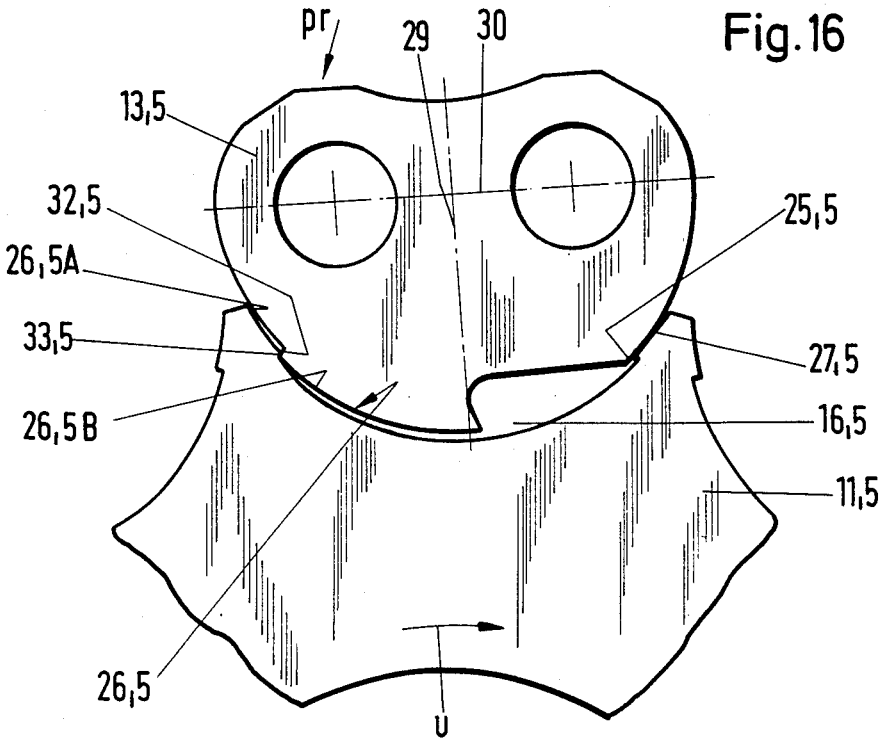
FIG. 16 is a drive link of FIG. 15 in the pivoted-in position corresponding to the illustration of FIG. 8.

In the embodiment of FIGS. 15 and 16, the drive link 13.5 is not configured with planar flanks; instead, the forward flank 25.5 and the rearward flank 26.5 are curved in the manner of a circular arc. The tooth gap 16.5 of the nose sprocket 11.5 is correspondingly configured so as to be dish-like and partially cylindrical so that the rearward tooth flank 27.5 and the forward tooth flank 28.5 function as sliding surfaces when the drive link 13.5 pivots in. The drive link 13.5 is essentially symmetrically configured with reference to the partition line 29 with the spacings of the two drive-link flanks to the partition line 29 in the foot region of the drive link being equal, said spacings being measured parallel to the connecting line 30. The rearward flank 26.5 of the drive link is stepped whereby two flank sections 26.5A and 26.5B are provided and a latch stop 32.5 is formed on the stepped transition.

Figure 18:
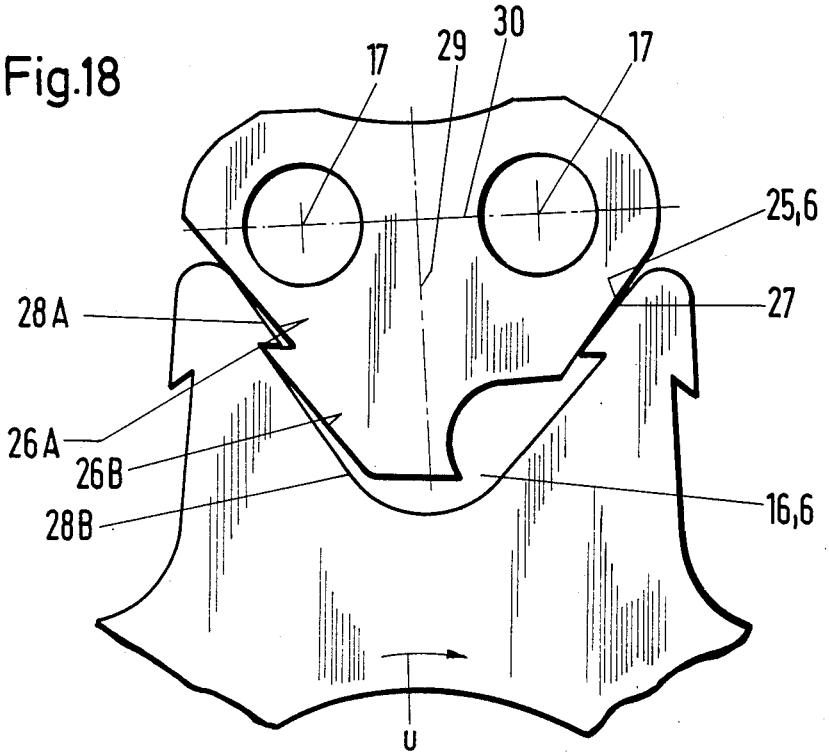

The tooth flanks 27.5 and 28.5 are likewise stepped. Accordingly, an abutment 33.5 of the nose sprocket 11.5 is provided for the latch stop 32.5. The transverse surfaces which form the latch stop and the abutment, respectively, lie at approximately right angles to the adjoining flank sections. In the normal loaded condition, the drive link 13.5 lies with a portion of the section 26.5B of the rearward flank 26.5 against the outer section of the tooth flank 28.5 of the tooth 15.5. On the opposite lying other side, the forward flank 25.5 of the drive link lies against the outer section of the tooth flank 27.5 of the forward tooth 15.5. With the forward thrust on the chain saw into the wood, the force pr acts upon the drive link 13.5 and displaces the same in the counter-clockwise direction (FIG. 18). The force pr results from the reaction force to the thrust force and to the cutting force. In this action, the latch stop 32.5 engages the abutment 33.5 from below so that the drive link remains latched in its pivoted position by means of this form lock until it leaves the nose sprocket 11.5.

Figure 17:
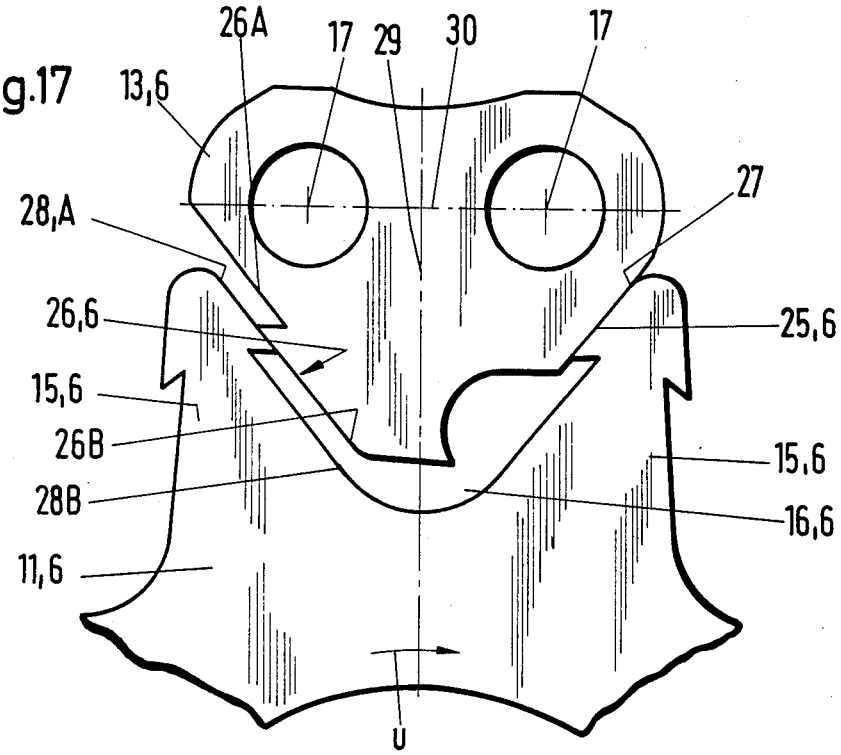
FIG. 17 is a drive link of an other embodiment with the associated nose sprocket in an illustration corresponding to FIG. 7; and, FIG. 18 is the drive link according to FIG. 17 in the pivoted-in position corresponding to the illustration of FIG. 8.

The embodiment shown in FIGS. 17 and 18 is similar to that shown in FIGS. 7 and 8. However, the drive link 13.6 is here configured so as to be symmetrical to the partition line 29 so that in the normal position, that is during idle of the saw chain, the forward flank 25.6 of the drive link also lies in flat contact engagement with the tooth flank 27 of the leading tooth 15.6. The reaction force from the thrust force and the cutting force causes a counter-displacement of both drive-link flanks so that the position shown in FIG. 18 is reached wherein the rearward pivot axis 17 is displaced in the direction toward the tooth gap 16.6.

A substantial advantage of the embodiment according to the invention of the saw chain and/or of the nose sprocket is that the free angle of the sawtooth is reduced only in the region of the nose sprocket when the reaction forces suddenly increase intensely and thereby threaten a kickback, that is, a throwback of the chain saw. Accordingly, the reduction of the free angle only occurs sporadically so that the cutting capacity of the saw which is dependent upon the free angle is reduced only slightly overall.

It is understood that the foregoing description is that of the preferred embodiments of the invention and that various changes and modifications may be made thereto without departing from the spirit and scope of the invention as defined in the appended claims.

What is claimed is:

1. A motor-driven chain saw comprising:

a housing;

a guide bar mounted on said housing and having upper and lower edges and a nose sprocket rotatably mounted in the forward end thereof;

said nose sprocket having a plurality of teeth and each two mutually adjacent ones of said teeth having respective adjacent tooth flanks conjointly defining a tooth gap;

a plurality of links interconnected by rivet pins or the like to form an endless saw chain guided on said guide bar on said edges and on said nose sprocket;

a first portion of said links being cutting links and a second portion of said links being drive links;

each one of said cutting links including: a plate-like cutting-link body having an upwardly extending rearward portion defining a cutting tooth; a forward upwardly extending portion defining a depth limiter; a forward bore opening for accommodating one of said rivet pins therein to define a forward cutting-link pivot axis; and, a rearward bore opening for accommodating an other one of said rivet pins therein to define a rearward cutting-link pivot axis;

each one of said drive links being a plate-like body having a forward bore and a rearward bore for accommodating two of said pins to define respective forward and rearward drive-link pivot axes;

each one of said cutting links being pivotally connected with a forward drive link directly forward thereof so that the rearward drive-link pivot axis of the latter is coincident with said forward cutting-link pivot axis and each one of said cutting links also being pivotally connected with a rearward drive link directly rearward thereof so that the forward drive-link pivot axis of the latter is coincident with said rearward cutting-link pivot axis;

each one of said drive links being configured to engage one of said tooth gaps when entering said nose sprocket and having two downwardly extending drive-link flanks for contact engaging corresponding ones of said tooth flanks of said tooth gap, one of said drive-link flanks being a forward drive-link flank viewed in the direction of movement of said saw chain and the other one of said drive-link flanks being a rearward drive-link flank;

said cutting link being atop one of the teeth of said nose sprocket in a first orientation with said forward and rearward drive links being in corresponding tooth gaps on opposite sides of said tooth;

said cutting tooth having a tooth roof extending rearwardly from said cutting edge thereof to define a free angle with a tangent to the circle traced by said cutting edge as the latter moves around the forward end of said guide bar, said free angle being determinative of the cut into wood for said first orientation;

at least one of said drive-link flanks of each of said drive links having a contour different from the contour of said tooth flanks and said one drive-link flank of said drive link being so configured that said drive link with a section of its forward drive-link flank contact engages the tooth flank corresponding thereto so as to be pivotally movable within said tooth gap from a normal first position of said drive link corresponding to said first orientation of said cutting link to a second position in response to a reaction load applied to the saw chain wherein said cutting link is shifted to a second orientation on said one tooth in which the magnitude of said free angle is reduced thereby reducing or eliminating kickback; and, latch means formed on one of said tooth flanks for blocking a return pivoting of said drive link.

2. The motor-driven chain saw of claim 1, said latch means comprising: a latch stop formed one one of said drive-link flanks; and, an abutment formed on the tooth directly adjacent said one drive-link flank.

3. The motor-driven chain saw of claim 2, said latch stop being formed as a dove-tail projection on said one drive-link flank; and, said abutment being likewise formed as a dove-tail projection on said tooth.

4. The motor-driven chain saw of claim 2, said abutment being a leaf spring seated in said tooth for engaging said latch stop when said drive link is in said second position.

5. The motor-driven chain saw of claim 4, said abutment including a recess formed in the tooth flank of said tooth directly adjacent said one drive-link flank so as to permit said leaf spring to be recessed into said recess when said drive-link flank engages thereagainst in said first position of said drive link.

6. The motor-driven chain saw of claim 2, each of said drive links having a lower foot portion joining said two drive-link flanks to each other, said drive link having a recess formed in said plate-like body thereof which is disposed in the transition region from said foot portion into said one drive-link flank so as to form a corner defining said latch stop on said one drive-link flank; and, said abutment being a surface formed on the tooth flank of said tooth directly adjacent said one drive-link flank, said surface being a surface transverse to said tooth flank for engaging said corner when said drive link is in said second position.

7. The motor-driven chain saw of claim 2, said abutment comprising a resilient arm formed on said tooth: and, said latch stop comprising two cutouts formed on said one drive-link flank in the direction of the latter so as to permit one of said cutouts to engage said arm in said first position of said drive link and so as to permit the other one of said cutouts to engage said arm in said second position of said drive link.

8. The motor-driven chain saw of claim 7, each one of said drive links having a lower foot portion joining said two drive-link flanks to each other; said resilient arm being formed by a separating slit cut into said tooth; and, said other one of said cutouts being closer to said foot portion than said one of said cutouts; said resilient arm being recessible into said separating slit when said arm is in contact engagement with the wall surface of said drive-link flank defining said other cutout.

9. The motor-driven chain saw of claim 2, said tooth flanks being formed to conjointly define a tooth gap which is partially cylindrical; and, said drive link flanks likewise being configured so as to be partially cylindrical; said tooth gap and said drive-link flanks lying on respective circular arcs which are concentric; said latch stop being a step formed on one of said drive-link flanks; and, said abutment likewise being a step and being formed on the tooth flank of said tooth directly adjacent said one drive-link flank.

10. The motor-driven chain saw of claim 1, each one of said drive links being configured so as to be unsymmetrical with respect to a partition line which perpendicularly and centrally intersects a connecting line of said drive-link pivot axes, said drive-link flanks defining respective angles with said partition line, one of said angles being greater than the other one of said angles.

11. The motor-driven chain saw of claim 10, said forward drive-link flank and said partition line conjointly defining a forward flank angle $\beta 1$ and said rearward drive-link flank and said partition line conjointly defining a rearward flank angle $\beta 2$, said forward flank angle $\beta 1$ being greater than said rearward flank angle $\beta 2$ such that a wedge gap Kv is formed between said forward drive-link flank and the tooth flank of said tooth directly adjacent said forward drive-link flank when said drive link is in said first position.

12. The motor-driven chain saw of claim 1, each of said drive-link flanks being straight-lined throughout.

13. The motor-driven chain saw of claim 1, each of said drive-link flanks being subdivided along its length into mutually adjacent straight-line sections.

14. The motor-driven chain saw of claim 1, one of said drive-link flanks being subdivided along its length into mutually adjacent convexly curved sections.

15. A guide bar and saw chain assembly for a motor-driven chain saw, the assembly comprising:

a guide bar mountable on the chain saw and having upper and lower edges and a nose sprocket rotatably mounted on the forward end thereof;

said nose sprocket having a plurality of teeth and each two mutually adjacent ones of said teeth having respective adjacent tooth flanks conjointly defining a tooth gap;

a plurality of links interconnected by rivet pins or the like to form an endless saw chain guided on said guide bar on said edges and on said nose sprocket;

a first portion of said links being cutting links and a second portion of said links being drive links;

each one of said cutting links including: a plate-like cutting-link body having an upwardly extending rearward portion defining a cutting tooth; a forward upwardly extending portion defining a depth limiter; a forward bore opening for accommodating one of said rivet pins therein to define a forward cutting-link pivot axis; and, a rearward bore opening for accommodating an other one of said rivet pins therein to define a rearward cutting-link pivot axis;

each one of said drive links being a plate-like body having a forward bore and a rearward bore for accommodating two of said pins to define respective forward and rearward drive-link pivot axes;

each one of said cutting links being pivotally connected with a forward drive link directly forward thereof so that the rearward drive-link pivot axis of the latter is coincident with said forward cutting-link pivot axis and each one of said cutting links also being pivotally connected with a rearward drive link directly rearward thereof so that the forward drive-link pivot axis of the latter is coincident with said rearward cutting-link pivot axis;

each one of said drive links being configured to engage one of said tooth gaps when entering said nose sprocket and having two downwardly extending drive-link flanks for contact engaging corresponding ones of said tooth flanks of said tooth gap, one of said drive-link flanks being a forward drive-link flank viewed in the direction of movement of said saw chain and the other one of said drive-link flanks being a rearward drive-link flank;

said cutting link being atop one of the teeth of said nose sprocket in a first orientation with said forward and rearward drive links being in corresponding tooth gaps on opposite sides of said tooth;

said cutting tooth having a tooth roof extending rearwardly from said cutting edge thereof to define a free angle with a tangent to the circle traced by said cutting edge as the latter moves around the forward end of said guide bar, said free angle being determinative of the cut into wood for said first orientation;

at least one of said drive-link flanks of each of said forward drive links having a contour different from the contour of said tooth flanks and said one drive-link flank of said forward drive link being so configured that said drive link with a section of its forward drive-link flank contact engages the tooth flank corresponding thereto so as to be pivotally movable within said tooth gap from a normal first position of said drive link corresponding to said first orientation of said cutting link to a second position in response to a reaction load applied to the saw chain wherein said cutting link is shifted to a second orientation on said one tooth in which the magnitude of said free angle is reduced thereby reducing or eliminating kickback; and, latch means formed on one of said tooth flanks for blocking a return pivoting of said drive link.

* * * * *

UNITED STATES PATENT AND TRADEMARK OFFICE

CERTIFICATE OF CORRECTION

PATENT NO. : 4,754,549

DATED : July 5, 1988

INVENTOR(S) : Manfred Fischer, Wilfried Linke and Werner Hartmann

It is certified that error appears in the above-identified patent and that said Letters Patent is hereby corrected as shown below:

In column 5, line 35: delete "drive-link" and substitute -- drive link -- therefor.

In column 5, line 38: delete "drive-link" and substitute -- drive link -- therefor.

In column 5, line 46: delete "drive-link" and substitute -- drive link -- therefor.

In column 5, line 54: delete "drive-link" and substitute -- drive link -- therefor.

In column 5, line 55: delete "drive-link" and substitute -- drive link -- therefor.

In column 5, line 60: delete "81" and substitute -- ß1 -- therefor.

UNITED STATES PATENT AND TRADEMARK OFFICE

CERTIFICATE OF CORRECTION

PATENT NO. : 4,754,549

DATED : July 5, 1988

INVENTOR(S) : Manfred Fischer, Wilfried Linke and Werner Hartmann

It is certified that error appears in the above-identified patent and that said Letters Patent is hereby corrected as shown below:

In column 6, line 13: delete "drive-link" and substitute -- drive link -- therefor.

In column 6, line 15: delete "drive-link" and substitute -- drive link -- therefor.

In column 6, line 16: delete "drive-link" and substitute -- drive link -- therfor.

In column 6, line 24: delete "drive-link" and substitute -- drive link -- therefor.

In column 6, line 26: delete "drive-link" and substitute -- drive link -- therefor.

In column 9, line 32: delete "one", first occurrence and substitute -- on -- therfor.

Signed and Sealed this

Twenty-second Day of August, 1989

*Attest:*

*Attesting Officer*

DONALD J. QUIGG

*Commissioner of Patents and Trademarks*